US011763762B2

(12) United States Patent
Liu et al.

(10) Patent No.: US 11,763,762 B2
(45) Date of Patent: Sep. 19, 2023

(54) IMAGE PROCESSING METHOD, IMAGE PROCESSING DEVICE, AND DISPLAY DEVICE

(71) Applicant: BOE Technology Group Co., Ltd., Beijing (CN)

(72) Inventors: Hanwen Liu, Beijing (CN); Yanhong Wu, Beijing (CN); Lijie Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 108 days.

(21) Appl. No.: 17/417,468

(22) PCT Filed: Dec. 30, 2020

(86) PCT No.: PCT/CN2020/141470

§ 371 (c)(1),
(2) Date: Jun. 23, 2021

(87) PCT Pub. No.: WO2021/136391

PCT Pub. Date: Jul. 8, 2021

(65) Prior Publication Data

US 2022/0343865 A1 Oct. 27, 2022

(30) Foreign Application Priority Data

Jan. 3, 2020 (CN) ..... 202010004914.0

(51) Int. Cl.
*G09G 3/34* (2006.01)

(52) U.S. Cl.
CPC ..... *G09G 3/344* (2013.01); *G09G 2340/06* (2013.01)

(58) Field of Classification Search
None
See application file for complete search history.

(56) References Cited

U.S. PATENT DOCUMENTS 6,108,441 A 8/2000 Hiratsuka et al.
7,116,338 B2 * 10/2006 Fukao ..... G09G 5/02 715/848

(Continued)

FOREIGN PATENT DOCUMENTS

CN 102496149 A 6/2012
CN 102591087 A 7/2012

(Continued)

OTHER PUBLICATIONS

International Search Report dated Nov. 26, 2020 corresponding to application No. PCT/CN2020/110944.

(Continued)

*Primary Examiner* — Matthew Yeung
(74) *Attorney, Agent, or Firm* — Nath, Goldberg & Meyer; Joshua B. Goldberg

(57) ABSTRACT

The present disclosure provides an image processing method, an image processing device, and a display device. The image processing method includes: acquiring image data including display data of all of pixels of an image; and performing, on the display data of each of the pixels, operations of: determining Euclidean distances from the display data of the pixel to the display data of a first pure color, the display data of a second pure color, and the display data of a third pure color in a set color space; and replacing the display data of the pixel with one of the display data of the first pure color, the display data of the second pure color and the display data of the third pure color according to the determined Euclidean distances and a preset rule.

17 Claims, 4 Drawing Sheets

(56) References Cited

U.S. PATENT DOCUMENTS

| | | | | |
|---|---|---|---|---|
| 10,319,116 | B1 | 6/2019 | C et al. | |
| 2002/0176622 | A1* | 11/2002 | Watanabe | G06T 9/005 382/165 |
| 2006/0187189 | A1 | 8/2006 | Komatsu | |
| 2008/0174932 | A1 | 7/2008 | Kim et al. | |
| 2009/0060326 | A1 | 3/2009 | Imai et al. | |
| 2009/0268961 | A1 | 10/2009 | Lu et al. | |
| 2016/0232686 | A1 | 8/2016 | Park et al. | |
| 2018/0033164 | A1 | 2/2018 | Seo et al. | |
| 2018/0070107 | A1* | 3/2018 | Ramasubramonian | H04N 19/70 |
| 2019/0311464 | A1* | 10/2019 | Chuang | G06T 7/90 |

FOREIGN PATENT DOCUMENTS

| | | | |
|---|---|---|---|
| CN | 102592272 | A | 7/2012 |
| CN | 102651136 | A | 8/2012 |
| CN | 103246123 | A | 8/2013 |
| CN | 103339944 | A | 10/2013 |
| CN | 104317131 | A | 1/2015 |
| CN | 107659779 | A | 2/2018 |
| CN | 108124139 | A | 6/2018 |
| CN | 108846812 | A | 11/2018 |
| CN | 109191384 | A | 1/2019 |
| CN | 109636753 | A | 4/2019 |
| CN | 109697739 | A | 4/2019 |
| CN | 110007541 | A | 7/2019 |
| CN | 110120080 | A | 8/2019 |
| CN | 110570380 | A | 12/2019 |
| CN | 110634169 | A | 12/2019 |
| CN | 111161683 | A | 5/2020 |

OTHER PUBLICATIONS

First Office Action dated Nov. 4, 2020 corresponding to Chinese application No. 202010004914.0.

First Office Action dated Sep. 12, 2019 corresponding to Chinese application No. 201910863448.9.

* cited by examiner

IMAGE PROCESSING METHOD, IMAGE PROCESSING DEVICE, AND DISPLAY DEVICE

CROSS-REFERENCE TO RELATED APPLICATION

This is a National Phase Application filed under 35 U.S.C. 371 as a national stage of PCT/CN2020/141470, filed Dec. 30, 2020, an application claiming the benefit of Chinese patent application No. 202010004914.0 filed on Jan. 3, 2020, the entirety of each of which is incorporated herein by reference.

TECHNICAL FIELD

The present disclosure relates to the field of display and image processing technologies, and in particular, to an image processing method, an image processing device, and a display device.

BACKGROUND

An existing electronic ink display device (also called an electronic book) can only display two colors of black and white. If an image to be displayed is a color image, an image processing device in the electronic ink display device generally converts display data of the color image into display data of the black-and-white image according to a certain algorithm, and then provides the display data of the black-and-white image to an electronic ink screen to display. Recently, electronic ink screens capable of displaying three colors of black, white, and red have been developed.

SUMMARY

Embodiments of the present disclosure provide an image processing method, including:

acquiring image data, the image data including display data of all of pixels of an image; and performing, on the display data of each of the pixels, operations of:

determining Euclidean distances from the display data of the pixel to display data of a first pure color, display data of a second pure color, and display data of a third pure color in a set color space; and replacing the display data of the pixel with one of the display data of the first pure color, the display data of the second pure color, and the display data of the third pure color according to the determined Euclidean distances and a preset rule.

In some embodiments, the image processing method further includes:

selecting a pixel from among all of the pixels of the image in a predetermined order such that the operations are performed on the display data of each of the pixels; and after replacing the display data of the pixel with one of the display data of the first pure color, the display data of the second pure color, and the display data of the third pure color according to the determined Euclidean distances and the preset rule, performing error diffusion using a predetermined error diffusion template based on a difference between the display data and the replaced display data of the pixel to correct the display data of pixels on which the replacing of the display data is not performed around the pixel.

In some embodiments, the predetermined error diffusion template is a Floyd-Steinberg error diffusion template or a Jarris-Judice-Ninke error diffusion template.

In some embodiments, the preset rule includes:

replacing the display data of the pixel with one, which corresponds to a smallest one of a first distance, a second distance, and a third distance, among the display data of the first pure color, the display data of the second pure color, and the display data of the third pure color, the first distance being the Euclidean distance from the display data of the pixel to the display data of the first pure color in the set color space, the second distance being the Euclidean distance from the display data of the pixel to the display data of the second pure color in the set color space, and the third distance being the Euclidean distance from the display data of the pixel to the display data of the third pure color in the set color space.

In some embodiments, the preset rule includes:

multiplying a first distance by a first coefficient to obtain a first corrected distance, the first distance being the Euclidean distance from the display data of the pixel to the display data of the first pure color in the set color space;

multiplying a second distance by a second coefficient to obtain a second corrected distance, the second distance being the Euclidean distance from the display data of the pixel to the display data of the second pure color in the set color space;

multiplying a third distance by a third coefficient to obtain a third corrected distance, the third distance being the Euclidean distance from the display data of the pixel to the display data of the third pure color in the set color space; and replacing the display data of the pixel with one, which corresponds to a smallest one of the first corrected distance, the second corrected distance, and the third corrected distance, among the display data of the first pure color, the display data of the second pure color, and the display data of the third pure color.

In some embodiments, the first pure color, the second pure color, and the third pure color are pure black, pure white, and pure red, respectively.

In some embodiments, the set color space is an RGB color space or an HSV color space.

Embodiments of the present disclosure further provide an image processing device including a memory storing instructions and a processor running the instructions to perform the image processing method described above.

Embodiments of the present disclosure further provide a display device including the image processing device described above.

In some embodiments, the display device includes an electronic ink display device.

DETAILED DESCRIPTION

To improve understanding of the technical solution of the present disclosure for those skilled in the art, the present disclosure will now be described in detail with the help of accompanying drawings and specific embodiments.

The present disclosure provides an image processing method that maximally preserves information in an original color image while converting the original color image into a three-color image.

Figure 1:
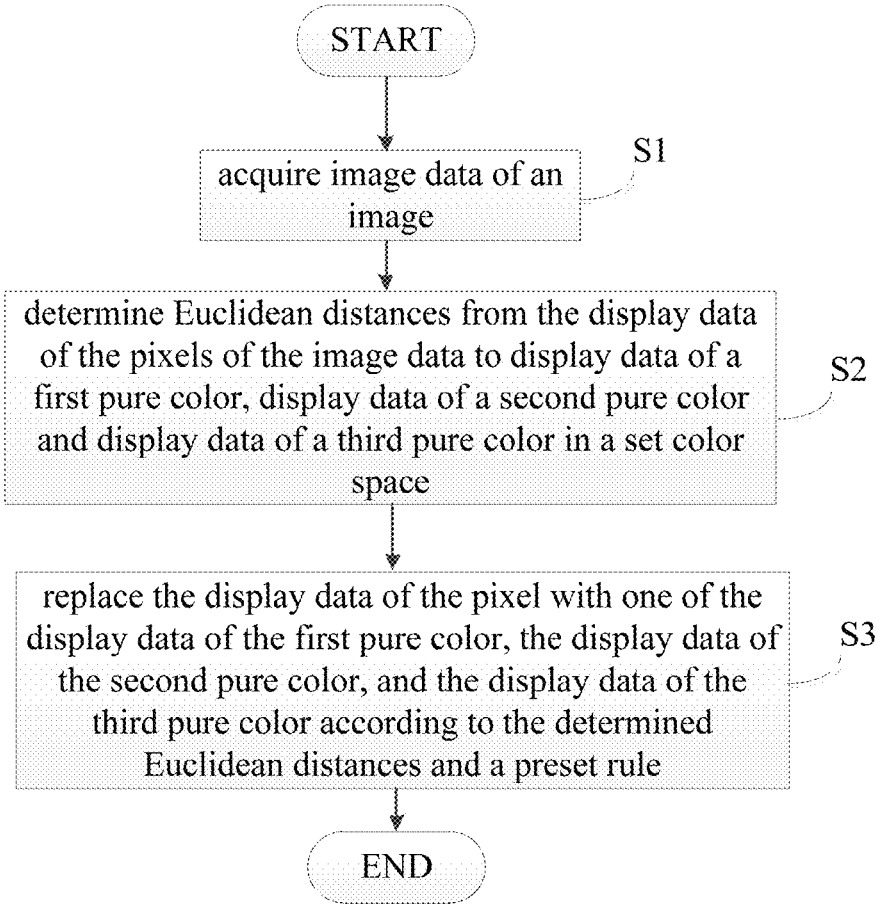
FIG. 1 is a flowchart illustrating an example of an image processing method according to an embodiment of the present disclosure.

FIG. 1 is a flowchart illustrating an example of an image processing method according to an embodiment of the present disclosure.

Referring to FIG. 1, the image processing method according to an embodiment of the present disclosure includes steps S1 through S3.

In step S1, image data including display data of all of pixels of an image is acquired.

The image data is generally a matrix in rows and columns. Each of elements of the matrix includes the display data of a corresponding pixel in the image. The display data of a pixel indicates a display color of the pixel when it is displayed. The display data of the pixel may be implemented as a vector containing 3 elements. In some embodiments, the vector representing the display data of the pixel may be (r, g, b), where r represents a gray scale value of a red subpixel of the pixel, represents a gray scale value of a green subpixel of the pixel, and b represents a gray scale value of a blue subpixel of the pixel.

In step S2, Euclidean distances from the display data of the pixels of the image data to display data of a first pure color, display data of a second pure color, and display data of a third pure color in a set color space are determined. Display data of a pure color (for example, the first pure color) means that the display color of the pixel is the pure color when the pixel is displayed using the display data. In the present disclosure, "pure color" (e.g., the first pure color) and "display data of pure color" (e.g. the display data of the first pure color) may be used interchangeably.

In an electronic ink display device, each of the pixels may only be displayed as a pure color. In some embodiments, the electronic ink display device may only display pure white, pure black, and pure red, and the first pure color, the second pure color, and the third pure color are pure white, pure black, and pure red, respectively, but the present disclosure is not limited thereto. For example, in some embodiments, the first, second, and third pure colors are pure white, pure black, and pure green, respectively. In the present disclosure, the pure red (or red) means pure red with a highest brightness, the pure green (or green) means pure green with a highest brightness, and so on.

It should be noted that, in the present disclosure, the gray scale value of each of the first, second, and third pure colors is constant. For example, in an RGB color space having a maximum gray scale value of 255, the display data of the pure white is (255, 255, 255), the display data of the pure black is (0, 0, 0), and the display data of the pure red is (255, 0, 0).

Three coordinate axes orthogonal to each other in the RGB color space each may indicate the gray scale (or the brightness) of one of the subpixels of each pixel. Coordinates (i.e., the display data) of the pure white in the RGB color space may be (255, 255, 255), coordinates (i.e., the display data) of the pure black in the RGB color space may be (0, 0, 0), and coordinates (i.e., the display data) of the pure red in the RGB color space may be (255, 0, 0).

In the case that the display data of the pixel is (r, g, b), in the RGB color space, the Euclidean distance from the display data of the pixel to the pure white may be defined as $d_{to\text{-}white}=\sqrt{(r-255)^2+(g-255)^2+(b-255)^2}$, the Euclidean distance from the display data of the pixel to the pure black may be defined as $d_{to\text{-}black}=\sqrt{(r-0)^2+(g-0)^2+(b-0)^2}$, and the Euclidean distance from the display data of the pixel to the pure red may be defined as $d_{to\text{-}red}=\sqrt{(r-255)^2+(g-0)^2+(b-0)^2}$.

The set color space is not limited to the RGB color space. For example, in some embodiments, the set color space may be an HSV color space including hue h, saturation s, and value v, where the display data of a pixel may be implemented as a vector (h, s, v).

The hue h is measured in angle and ranges from 0° to 360° (also abbreviated as 0 to 360).

The saturation s represents a degree to which a color approaches a spectral color. Each color may be viewed as a result of a mixture of a spectral color and white, where the higher the proportion of the spectral color is, the closer the color is to the spectral color, and thus the higher the saturation s is. When the saturation s is high, the color is deep and vivid. The saturation s ranges from 0% to 100% (also abbreviated as 0 to 100), where the saturation of the spectral color is 100%.

Value v represents a degree of brightness, and ranges from 0% (representing black, being darkest) to 100% (representing white, being brightest) (which may also be abbreviated as 0 to 100).

The display data may be converted from the RGB color space to the HSV color space according to following formulas.

$$h=\begin{cases}0^\circ & \text{if } \max=\min\\ 60^\circ\times\dfrac{g-b}{\max-\min}+0^\circ & \text{if } \max=r \text{ and } g\geq b\\ 60^\circ\times\dfrac{g-b}{\max-\min}+360^\circ & \text{if } \max=r \text{ and } g<b\\ 60^\circ\times\dfrac{b-r}{\max-\min}+120^\circ & \text{if } \max=g\\ 60^\circ\times\dfrac{r-g}{\max-\min}+240^\circ & \text{if } \max=b\end{cases},$$

$$s=\begin{cases}0 & \text{if } \max=0\\ 1-\dfrac{\min}{\max} & \text{otherwise}\end{cases},$$

$$v=\max.$$

In the formulas, max denotes a maximum value among the three elements r, g, b of the display data (r, g, b) of the pixel in the RGB color space, and min denotes a minimum value among the three elements r, g, b of the display data (r, g, b) of the pixel in the RGB color space.

It is assumed that the display data of the pixel in the HSV color space is (h, s, v), its coordinates in the HSV color space in a rectangular coordinate system are: (r*v*s*cosh, r*v*s*sinh, h* (1-v)). That is, the coordinates of the display data of the pixel in the HSV color space expressed in the rectangular coordinate system can be calculated by using the formula of (r*v*s*cosh, r*v*s*sinh, h*(1-v)). Subsequently, a Euclidean distance $d_{to\text{-}white}$ from the display data of a pixel to the pure white in the HSV color space, a Euclidean distance $d_{to\text{-}black}$ from the display data of the pixel to the pure black in the HSV color space, and a Euclidean distance $d_{to\text{-}red}$ from the display data of the pixel to the pure red in the HSV color space may be calculated based on the coordinates of the display data of the pixel in the HSV color space and the coordinates of the pure white, the pure black, and the pure red in the HSV color space.

In step S3, the display data of the pixel is replaced with one of the display data of the first pure color, the display data of the second pure color, and the display data of the third pure color according to the determined Euclidean distances from the display data of the pixel to the display data of the first pure color, the display data of the second pure color, and the display data of the third pure color in the set color space and a preset rule.

In some embodiments, the display data of the pixel is replaced with one, which has a smaller Euclidean distance from the display data of the pixel, among the display data of the three pure colors.

In some embodiments, the replacement of the display data of each pixel does not affect other pixels, but the present disclosure is not so limited. In some embodiments, the replacement of the display data of a pixel may affect the display data of other pixels that has not been replaced, it should be noted that, in some embodiments, the display data of pixels that has not been replaced may be adjusted to reduce the impact from the replacement of display data of other pixels, and when replacing the adjusted display data of the pixels, the adjusted display data of each of the pixels may be a vector with unambiguous element values.

It should be understood that the above steps S2 and S3 may be performed on the display data of each of the pixels included in the image data. In some embodiments, a pixel is selected from all of the pixels of the image data in a predetermined order and the above steps S2 and S3 are performed on the display data of the selected pixel to enable the above steps S2 and S3 to be performed on the display data of each of the pixels included in the image data.

In some embodiments, selecting a pixel from all of the pixels of the image data in a predetermined order may include: selecting pixels row by row and selecting a pixel column by column in the same row to determine the selected pixel. In some embodiments, selecting a pixel from all of the pixels of the image data in a predetermined order may include: selecting pixels column by column and selecting a pixel row by row in the same column to determine the selected pixel.

Two exemplary preset rules for the replacement of the display data of the pixel are described below.

In some embodiments, the preset rule includes: replacing the display data of the pixel with one, which corresponds to a smallest one of a first distance, a second distance, and a third distance, among the display data of the first pure color, the display data of the second pure color, and the display data of the third pure color. The first distance is the Euclidean distance from the display data of the pixel to the display data of the first pure color in the set color space, the second distance is the Euclidean distance from the display data of the pixel to the display data of the second pure color in the set color space, and the third distance is the Euclidean distance from the display data of the pixel to the display data of the third pure color in the set color space.

In other words, the display color of the pixel is replaced with one of the first, second, and third pure colors that is closest to the display color of the pixel.

In some embodiments, the preset rule includes: multiplying a first distance by a first coefficient to obtain a first corrected distance, the first distance being the Euclidean distance from the display data of the pixel to the display data of the first pure color in the set color space; multiplying a second distance by a second coefficient to obtain a second corrected distance, the second distance being the Euclidean distance from the display data of the pixel to the display data of the second pure color in the set color space; multiplying a third distance by a third coefficient to obtain a third corrected distance, the third distance being the Euclidean distance from the display data of the pixel to the display data of the third pure color in the set color space; and replacing the display data of the pixel with one, which corresponds to a smallest one of the first corrected distance, the second corrected distance, and the third corrected distance, among the display data of the first pure color, the display data of the second pure color, and the display data of the third pure color.

In other words, when the display data of the pixel is replaced by using the preset rules, the final display effect has a bias. The smaller the first coefficient is, the more the display effect of the converted three-color image is biased toward the first pure color. The smaller the second coefficient is, the more the display effect of the converted three-color image is biased toward the second pure color. The smaller the third coefficient is, the more the display effect of the converted three-color image is biased toward the third pure color.

Figure 2:
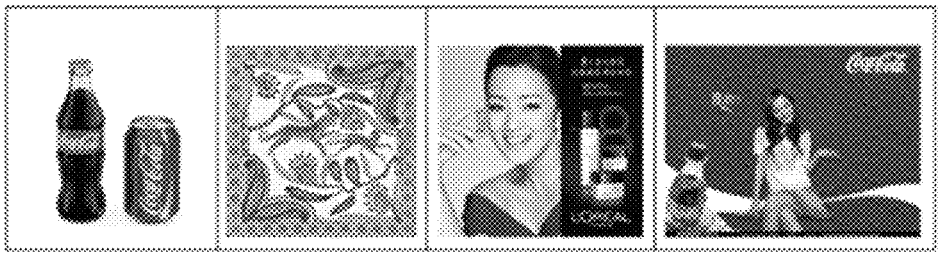
FIG. 2 is a diagram illustrating an example of an original color image.
Figure 3:
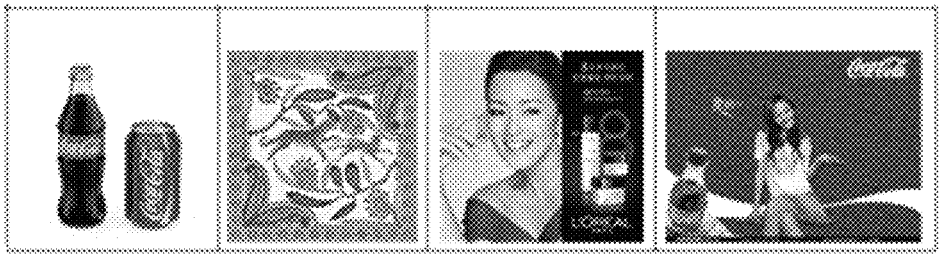
FIG. 3 is a diagram illustrating an example of a converted three-color image obtained by converting the original color image illustrated in FIG. 2 using an image processing method according to an embodiment of the present disclosure.

FIG. 2 is a diagram illustrating an example of an original color image, FIG. 3 is a diagram illustrating a three-color image, and the original color image illustrated in FIG. 2 is converted using an image processing method according to an embodiment of the present disclosure to obtain the three-color image illustrated in FIG. 3. It can be seen that the information of the original color image in FIG. 2 is retained to the greatest extent in the three-color image in FIG. 3.

In some embodiments, an error resulting from the replacement of the display data of a pixel may be proportionally transferred to the display data of the pixels that has not been replaced, i.e., the display data of the pixels that has not been replaced may be undesirably changed.

In some embodiments, the image processing method according to an embodiment of the present disclosure further includes: after step S3 is performed on the display data of the pixel, error diffusion is performed using a predetermined error diffusion template.

In some embodiments, the predetermined error diffusion template is a Floyd-Steinberg error diffusion template or a Jarvis-Judice-Ninke error diffusion template.

Typically, the Floyd-Steinberg error diffusion template may be implemented as:

$$\frac{1}{16}\begin{bmatrix} & * & 7 \\ 3 & 5 & 1 \end{bmatrix}.$$

In an embodiment of the present disclosure, the pixel being replaced is labeled by "*". As an example, in the case that the selected pixel is determined by selecting pixels row by row and selecting a pixel column by column in the same row and the display data of the pixel * after replacement has an error a compared to the display data of the pixel * before replacement, when the error diffusion is performed using the Floyd-Steinberg error diffusion template, 7/16 a is added to the display data of a pixel which is on the right side of and adjacent to the pixel * to correct the influence of the error a on the display data of the pixel which is on the right side of and adjacent to the pixel *. Similarly, 5/16 a is added to the display data of a pixel which is directly below and adjacent to the pixel * to correct the influence of the error a on the display data of the pixel which is directly below and adjacent to the pixel *. The display data of a pixel which is on the lower left side of and adjacent to the pixel * and the display data of a pixel which is on the lower right side of and adjacent to the pixel * are also corrected in a similar manner.

If there is no pixel on the right side of the pixel *, only the display data of the pixel which is directly below the pixel * and the display data of the pixel which is on the lower left side of the pixel * are corrected by using the coefficients recorded in the Floyd-Steinberg error diffusion template.

Typically, the Jarris-Judice-Ninke error diffusion template may be implemented as:

$$\frac{1}{48}\begin{bmatrix} & & * & 7 & 5 \\ 3 & 5 & 7 & 5 & 3 \\ 1 & 3 & 5 & 3 & 1 \end{bmatrix}.$$

Similar to the error diffusion performed by using the Floyd-Steinberg error diffusion template, when the error diffusion is performed by using the Jarris-judice-Ninke error diffusion template, the error diffusion is performed on the display data of 12 pixels around the pixel * that has not been replaced (in the case that there are 12 pixels of which the display data has not been replaced) by using corresponding coefficients recorded in the Jarris-judice-Ninke error diffusion template.

It should be understood that the parameters in the above error diffusion templates may be adjusted, and different parameters will result in different display effects.

Figure 4:
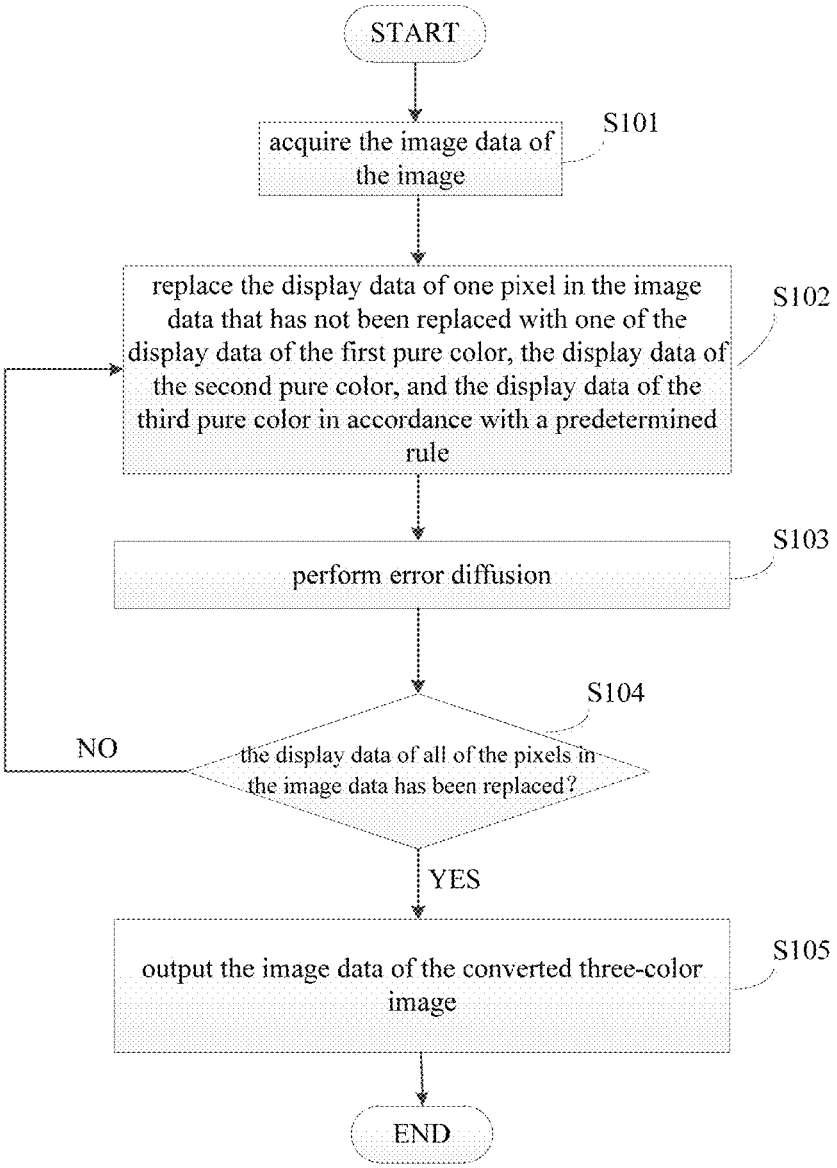
FIG. 4 is a flowchart illustrating another example of an image processing method according to an embodiment of the present disclosure.

FIG. 4 is a flowchart illustrating another example of an image processing method according to an embodiment of the present disclosure.

Referring to FIG. 4, a process of converting the color image into the three-color image using an image processing method according to an embodiment of the present disclosure may include steps S101 to S105.

In step S101, the image data of the image is acquired.

In step S102, the display data of one pixel in the image data that has not been replaced is replaced with one of the display data of the first pure color, the display data of the second pure color, and the display data of the third pure color in accordance with a predetermined rule. That is, each time step S102 is performed, the replaced display data of the one pixel in the image data is fixed. It should be understood that the replaced display data of a pixel means the display data of the pixel in the three-color image converted from the color image.

In step S103, the error diffusion is performed. Each time step S103 is performed, the display data of a plurality of pixels in the image data is corrected.

In step S104, it is determined whether the display data of all of the pixels in the image data has been replaced. If not, the image processing method proceeds to step S102 to replace the display data of a pixel which has not been replaced; otherwise, the image processing method proceeds to step S105.

In step S105, the image data of the converted three-color image is output.

Figure 5:
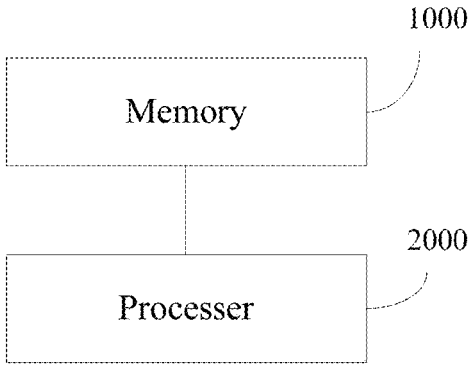
FIG. 5 is a block diagram illustrating an image processing device according to an embodiment of the present disclosure.

FIG. 5 shows an example of an image processing device according to an embodiment of the present disclosure.

Referring to FIG. 5, the image processing device according to an embodiment of the present disclosure includes a memory 1000 and a processor 2000, the memory 1000 stores instructions, and the processor 2000 runs the instructions to perform the above-described image processing method according to embodiments of the present disclosure.

The memory 1000 may be a device having a memory function such as a read only memory, a random access memory, or the like. The processor 2000 may be a device having a calculation function such as a central processing unit, a single chip microcomputer, or the like.

Figure 6:
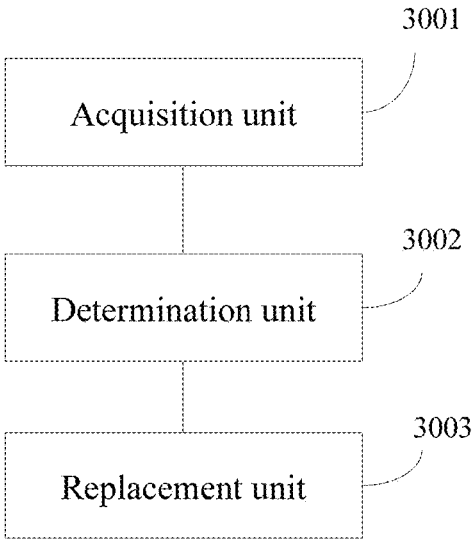
FIG. 6 is a block diagram illustrating an image processing device according to an embodiment of the present disclosure.

FIG. 6 shows another example of an image processing device according to an embodiment of the present disclosure.

Referring to FIG. 6, the image processing device according to an embodiment of the present disclosure includes: an acquisition unit 3001 configured to acquire image data; a determination unit 3002 configured to determine the Euclidean distances from the display data of the pixels in the image data to the display data of the first pure color, the display data of the second pure color, and the display data of the third pure color in a set color space; a replacement unit 3003 configured to replace the display data of each of the pixels with one of the display data of the first pure color, the display data of the second pure color, and the display data of the third pure color according to the determined Euclidean distances and a preset rule.

The acquisition unit, the determination unit, and the replacement unit each is used for realizing part of the steps of the image processing method according to the embodiments of the present disclosure. Each of the acquisition unit, the determination unit, and the replacement unit may be implemented by hardware such as an integrated circuit, and a field programmable gate array, or by software such as an instruction set executed by a processor such as a central processing unit, but the present disclosure is not limited thereto.

An embodiment of the present disclosure also provides a display device including the aforementioned image processing device according to the embodiments of the present disclosure.

The display device according to an embodiment of the present disclosure may be an electronic ink display device, but the present disclosure is not limited thereto.

It will be appreciated that the above embodiments are merely exemplary embodiments for the purpose of illustrating the principle of the present disclosure, and the present disclosure is not limited thereto. Various modifications and improvements can be made by a person having ordinary skill in the art without departing from the spirit and essence of the present disclosure. Accordingly, all of the modifications and improvements also fall into the protection scope of the present disclosure.

What is claimed is:

1. An image processing method, comprising:

acquiring image data, the image data comprising display data of all of pixels of an image;

performing, on the display data of each of the pixels, operations of:

determining Euclidean distances from the display data of the pixel to display data of a first pure color, display data of a second pure color, and display data of a third pure color in a set color space; and replacing the display data of the pixel with one of the display data of the first pure color, the display data of the second pure color, and the display data of the third pure color according to the determined Euclidean distances and a preset rule;

selecting a pixel from among all of the pixels of the image in a predetermined order such that the operations are performed on the display data of each of the pixels; and after replacing the display data of the pixel with one of the display data of the first pure color, the display data of the second pure color, and the display data of the third pure color according to the determined Euclidean distances and the preset rule, performing error diffusion using a predetermined error diffusion template based on a difference between the display data and the replaced display data of the pixel to correct the display data of pixels, on which the replacing of the display data is not performed, around the pixel.

2. The image processing method of claim 1, wherein the predetermined error diffusion template is a Floyd-Steinberg error diffusion template or a Jarris-Judice-Ninke error diffusion template.

3. The image processing method of claim 1, wherein the preset rule comprises:

replacing the display data of the pixel with one, which corresponds to a smallest one of a first distance, a second distance, and a third distance, among the display data of the first pure color, the display data of the second pure color, and the display data of the third pure color, the first distance being the Euclidean distance from the display data of the pixel to the display data of the first pure color in the set color space, the second distance being the Euclidean distance from the display data of the pixel to the display data of the second pure color in the set color space, and the third distance being the Euclidean distance from the display data of the pixel to the display data of the third pure color in the set color space.

4. The image processing method of claim 1, wherein the preset rule comprises:

multiplying a first distance by a first coefficient to obtain a first corrected distance, the first distance being the Euclidean distance from the display data of the pixel to the display data of the first pure color in the set color space;

multiplying a second distance by a second coefficient to obtain a second corrected distance, the second distance being the Euclidean distance from the display data of the pixel to the display data of the second pure color in the set color space;

multiplying a third distance by a third coefficient to obtain a third corrected distance, the third distance being the Euclidean distance from the display data of the pixel to the display data of the third pure color in the set color space; and replacing the display data of the pixel with one, which corresponds to a smallest one of the first corrected distance, the second corrected distance, and the third corrected distance, among the display data of the first pure color, the display data of the second pure color, and the display data of the third pure color.

5. The image processing method of claim 1, wherein the first pure color, the second pure color, and the third pure color are pure black, pure white, and pure red, respectively.

6. The image processing method of claim 1, wherein the set color space is an RGB color space or an HSV color space.

7. An image processing device comprising a memory storing instructions and a processor running the instructions to perform the image processing method of claim 1.

8. An image processing device comprising a memory storing instructions and a processor running the instructions to perform the image processing method of claim 2.

9. An image processing device comprising a memory storing instructions and a processor running the instructions to perform the image processing method of claim 3.

10. An image processing device comprising a memory storing instructions and a processor running the instructions to perform the image processing method of claim 4.

11. An image processing device comprising a memory storing instructions and a processor running the instructions to perform the image processing method of claim 5.

12. An image processing device comprising a memory storing instructions and a processor running the instructions to perform the image processing method of claim 6.

13. A display device, comprising the image processing device of claim 7.

14. A display device, comprising the image processing device of claim 8.

15. A display device, comprising the image processing device of claim 9.

16. A display device, comprising the image processing device of claim 10.

17. The display device of claim 13, wherein the display device comprises an electronic ink display device.

* * * * *